US007387555B1

(12) United States Patent
Mann

(10) Patent No.: US 7,387,555 B1
(45) Date of Patent: Jun. 17, 2008

(54) APPARATUS AND METHOD FOR BOAT ENGINE EXHAUST INJECTION SYSTEM

(76) Inventor: Larry Wayne Mann, P.O. Box 162107, Austin, TX (US) 78716

( * ) Notice: Subject to any disclaimer, the term of this patent is extended or adjusted under 35 U.S.C. 154(b) by 325 days.

(21) Appl. No.: 10/901,320

(22) Filed: Jul. 28, 2004

Related U.S. Application Data

(60) Provisional application No. 60/490,616, filed on Jul. 28, 2003.

(51) Int. Cl.
*B63H 21/00* (2006.01)

(52) U.S. Cl. ..... 440/89 R; 440/89 H; 440/89 E

(58) Field of Classification Search ..... 440/89 R, 440/89 E, 66, 89 H
See application file for complete search history.

(56) References Cited

U.S. PATENT DOCUMENTS

| | | | | | |
|---|---|---|---|---|---|
| 818,951 | A * | 4/1906 | Godwin | 181/235 |
| 1,054,301 | A * | 2/1913 | Mathis | 440/79 |
| 1,824,735 | A * | 9/1931 | Johnson | 440/53 |
| 1,824,736 | A * | 9/1931 | Johnson et al. | 440/53 |
| 1,840,948 | A * | 1/1932 | Harvey | 440/63 |
| 1,869,749 | A * | 8/1932 | Irgens | 181/235 |
| 2,713,841 | A * | 7/1955 | Forbes | 440/89 R |
| 3,162,999 | A * | 12/1964 | Benjamen | 60/310 |
| 3,537,419 | A * | 11/1970 | Holtermann et al. | 440/66 |
| 3,834,341 | A * | 9/1974 | Sexton et al. | 440/89 R |
| 5,212,949 | A * | 5/1993 | Shiozawa | 60/298 |
| 5,505,644 | A * | 4/1996 | Ousley et al. | 440/89 R |
| 5,591,058 | A * | 1/1997 | Schriever et al. | 440/89 R |
| 6,022,254 | A * | 2/2000 | Neisen | 440/89 R |

OTHER PUBLICATIONS

Earnest, et al; "Evaluation of the Fresh Air Exhaust TM System to Reduce Carbon Monoxide Exposure during Motor Boating and Wake Surfing"; Report No.: 171-35a; Aug. 2004, U.S. Dept. of Health and Human Services, Public Health Service, Centers for Disease Control and Prevention, National Institute for Occupational Safety and Health, Division of Applied Research and Technology.

* cited by examiner

*Primary Examiner*—Sherman Basinger

(57) ABSTRACT

An apparatus and method for injecting a boat engine's exhaust gasses into the boat propeller's propwash, aft of the propeller. The apparatus comprises piping which injects the boat engine's exhaust gasses into the propwash of the boat, aft of the propeller. This results in the movement of the exhaust gasses away from the boat thus protecting the health of the boat occupants, reduced levels of air pollutants, and a reduction in noise pollution. The injection piping includes several features that protect the boat in the event that the injection piping should strike a solid object in the water.

2 Claims, 6 Drawing Sheets

APPARATUS AND METHOD FOR BOAT ENGINE EXHAUST INJECTION SYSTEM

CROSS-REFERENCE TO RELATED APPLICATIONS

This application is related to and claims the benefit of Provisional Patent Application No. 60/490,616, dated Jul. 28, 2003, in which said provisional patent application incorporated by reference, Provisional Patent Application No. 60/486,962.

FEDERALLY SPONSORED RESEARCH

Not applicable

SEQUENCE LISTING OR PROGRAM

Not applicable

FIELD OF INVENTION

This invention relates to a device that injects inboard boat engine exhaust into the propwash aft of the propeller to move the exhaust away from the occupants in the boat or away from people being towed by the boat.

BACKGROUND OF THE INVENTION

An inboard boat is a boat where the engine is within the hull of the boat and the propeller shaft extends from the engine to the underside of the boat. These boats can range in size from small personal "runabouts" to huge ocean liners. Most inboard boats that are of the size between runabouts and ocean going yachts have the exhaust gasses exiting the boat at the stem (or rear) of the boat. Typically, the exhaust outlets protrude from and terminate at the transom (or rear component) of the boat.

As these boats travel forward, the boat creates an eddy current in the air that tends to draw the boat engine's exhaust gasses forward, into the boat (the station wagon effect). If the boat's engine is gasoline powered, the exhaust likely contains dangerous levels of carbon monoxide. There have been deaths and illness caused from this ingress of boat exhaust into boats. Young children and the unborn fetus are particularly at risk. If the boat's engine is diesel powered, the exhaust generally has lower levels of carbon monoxide than that produced by a gasoline engine, but contains high levels of sulfur oxides, which can cause a person to feel ill.

People have operated inboard boats for decades. It is only within the past few years that significant concern about the dangers of carbon monoxide poisoning from the operation of these boats has been raised. Because of this growing awareness of the problem, many drowning victims are now tested for blood levels of carboxyhemoglobin to determine if carbon monoxide was a factor in their drowning.

There is also an activity called "platform dragging", which has also been called "teak surfing" or "teak dragging", wherein a person will hang onto the swim platform at the rear of an inboard boat while the boat is moving forward. They are sometimes able to let go of the swim platform and body surf in the boat's wake. This activity is extremely dangerous as the person in the water typically has their face in the boat engine's exhaust stream. The carbon monoxide level of a gasoline powered boat engine's exhaust is likely high enough to cause a person to lose consciousness within 2 minutes. Recent research also raises concern about the carbon monoxide exposure of people towed behind the boat, such as water skiers.

There is patent pending design for a boat exhaust system that routes the boat engine's exhaust to the side of the boat, with the boat's operator able to select which side the exhaust will exit (Fineline Industries "Sideswipe exhaust system"). The Sideswipe system is designed to minimize the carbon monoxide levels to which a person surfing in the wake of the boat is exposed. The Sideswipe system does not reduce the carbon monoxide levels, nor does it eliminate the potential for the station wagon effect; it merely routes the exhaust to one side of the boat or the other, away from a person wakesurfing behind, and to one side, of the boat.

Stern drive (inboard/outboard) and outboard boat engines have routed their exhaust through their propellers for decades. Boats with this exhaust configuration appear to be less likely to suffer from the station wagon effect.

Research is underway to develop catalytic converters for boat engines that will reduce the levels of carbon monoxide in the engine exhaust. To date, the technological hurdles have yet to be overcome and catalytic converters are not currently available for boat engines. If they do become available, due to inherent design constraints, it is very unlikely that they can be retrofitted onto existing boats.

OBJECTS AND ADVANTAGES

The present invention began with the concept of routing the boat engine's exhaust away from a person surfing on the wake of the boat, protecting their life and health. The goal was to develop a system that could be retrofitted onto existing inboard boats.

A turning propeller of a boat creates propwash. Propwash is the portion of the water that is ejected behind a forward moving propeller and that is moving faster rearward than the propeller and boat are moving forward. It is generally cylindrical or conical in shape, and may extend as much as one hundred feet behind the boat. With the current invention, the boat engine's exhaust gasses are injected into the water, aft of the propeller, in the proximity of the propwash. By injecting the exhaust into the propwash, the exhaust is moved away from the back of a forward moving boat. If the exhaust is injected in front of a moving propeller, cavitation occurs. Cavitation decreases propeller efficiency and can pit, or damage a propeller. By injecting the exhaust into the propwash aft of the propeller, there is no propeller cavitation created by exhaust gasses. Since the exhaust gasses exit the boat below the waterline, any gasses that rise to the surface of the water are further behind the boat, resulting in lower exposure levels to a person being towed behind the boat. The current invention can be made to fit on all new inboard boats and retrofitted on to most, if not all existing inboard boats. The current invention can also be used on inboard jet drive boats.

Another advantage of the present invention is that it reduces engine exhaust noise, both within the boat and on shore. This reduction in noise levels is particularly beneficial in noise sensitive communities and wilderness areas. This results in a method of noise reduction for boats.

An unexpected advantage of the present invention is that it appears to reduce air pollution; further testing is required to quantify this reduction. Based upon testing to date, it appears that the level of carbon monoxide in the boat engine's exhaust is reduced due to the "scrubbing" action of the water. The scrubbing action appears to eliminate all or most of the particulate matter (soot) as well. This results in a method for pollution control for boats.

The present invention can be designed in such a way as to allow the portion of the exhaust system that is underwater to pivot, rotate, swing away, come loose, or break away in the event that the exhaust system strikes something in the water. This minimizes the potential for damage to the boat if an object is struck by the underwater portion of the current invention.

Other embodiments of this invention include mechanisms to move the underwater portion of the exhaust out of the water at higher speeds.

The shape, strength and manufacturing material can be modified to adjust to the needs of a particular boating environment. The following modifications are contemplated:

a) various materials of construction, both isotropic and anisotropic;

b) various streamlined shapes on the portion of the injection system that is within the water;

c) various diameters of the exhaust injection system to accommodate different sized engines;

d) different overall configurations to allow the exhaust to be routed around obstructions present on the transom of the boat, such as trim tabs, or routed within the boat;

e) installing all of the exhaust system inside the boat except for the portion that protrudes into the water;

f) various mechanisms that move the injection system out of the water during high speed boat operation; and g) modifying the shape of the portion of the injection system that is within the water to increase the flow of the exhaust gasses.

The present invention does not possess the limitations inherent in current or proposed boat engine exhaust modification systems. This system is currently available, can be incorporated into new boat designs, or can be retrofitted to install onto existing inboard boats.

An embodiment of the exhaust injection system is being utilized in a product called Fresh Air Exhaust™ by the applicant.

It is an object of the present invention to provide an improved exhaust system for inboard boats of all sizes. Other objects of the present invention are, to reduce the risk of morbidity or mortality from the operation of these boats, to provide the exhaust system with the capacity and strength to handle the various operating environments that are encountered, to be incorporated into the design of new inboard boats, and to be able to be retrofitted onto existing inboard boats.

SUMMARY

The exhaust injection system is an apparatus and method for reducing the levels of carbon monoxide and other exhaust gasses and suspended solids to which inboard boat occupants and persons being towed by the boat are exposed. The design is of an exhaust system where the boat engine's exhaust gasses are injected into the propwash of the boat, aft of the propeller. The result is a boat engine exhaust system that moves exhaust gasses and suspended solids away from the back of the boat and below the surface of the water when the boat is moving forward. The exhaust injection system also results in reduced noise pollution and air pollution.

DESCRIPTION

FIGURES

DETAILED DESCRIPTION OF EMBODIMENT

Exhaust Injection System

Figure 1:
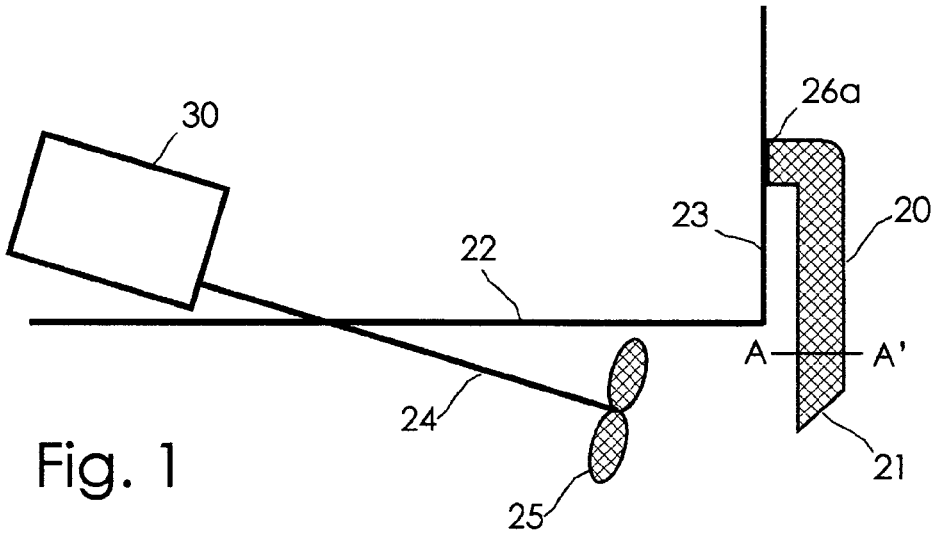
FIG. 1 is a side view of an embodiment of the invention showing the current invention mounted to the transom of the boat, aft of the propeller.
Figure 2:
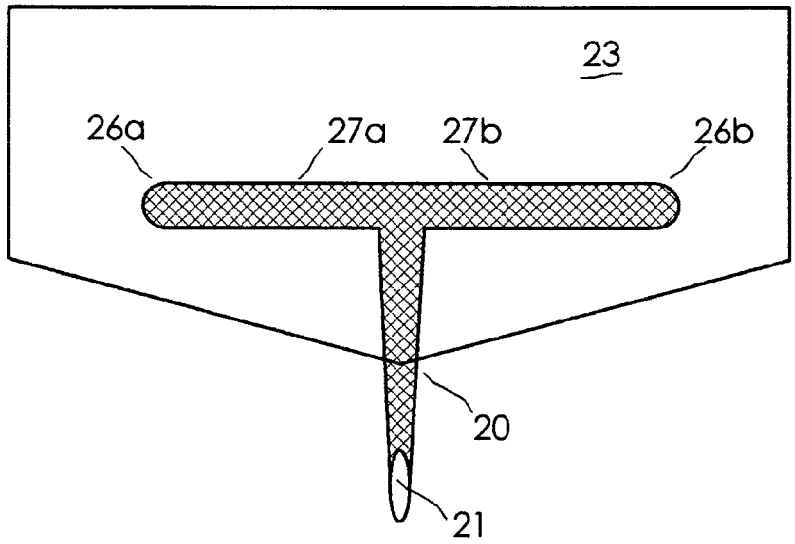
FIG. 2 is an end view of an embodiment of the invention attached to the transom of a boat where the boat has 2 exhaust outlets or 1 exhaust outlet off center and 1 dummy exhaust outlet installed.

In one embodiment of the invention, shown in FIGS. 1-2, the boat has two exhaust outlets. Since there are two exhaust outlets, there are two first ends of the exhaust injection system. The first ends of the exhaust injection system mount to the exhaust outlets 26*a* and 26*b* that exit from the transom (or stem) 23 of the boat. If the exhaust outlets 26*a* and 26*b* are stainless steel tubes, then the first end of the current invention connects to them by means of a four inch length of three inch inside diameter rubber hose and is fastened by means of hose clamps. If the exhaust outlets 26*a* and 26*b* are flanged outlets, then the first end of the current invention connects to them by means of flange plates.

Figure 7:
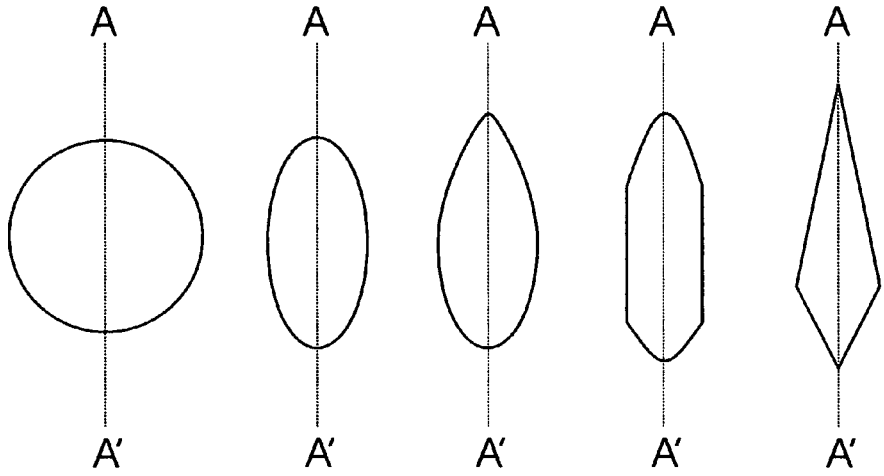
FIG. 7 is a cross sectional view of various embodiments of the injection pipe taken at A-A' on FIG. 1

The exhaust injection system travels from the exhaust outlets 26*a* and 26*b* rearward for a distance required to clear any other device attached to the transom, generally in the range of two to ten inches, and then from there, turns towards the midline of the boat to form the cross pipes 27*a* and 27*b*. The length of the cross pipes 27*a* and 27*b* is determined by the spacing between the exhaust outlets 26*a* and 26*b* but is generally between three and twenty inches. The cross pipes 27*a* and 27*b* meet in the midline and connect to an elongated component or injection pipe 20 that projects downward, generally vertical, below the hull of the boat 22 where the second end of the exhaust injection system 21 will be below the surface of the water (waterline). In this embodiment, the injection pipe 20 narrows as it progresses downward as shown in FIG. 2 and is shaped through its cross section in a streamlined configuration as shown in FIG. 7.

Figure 8:
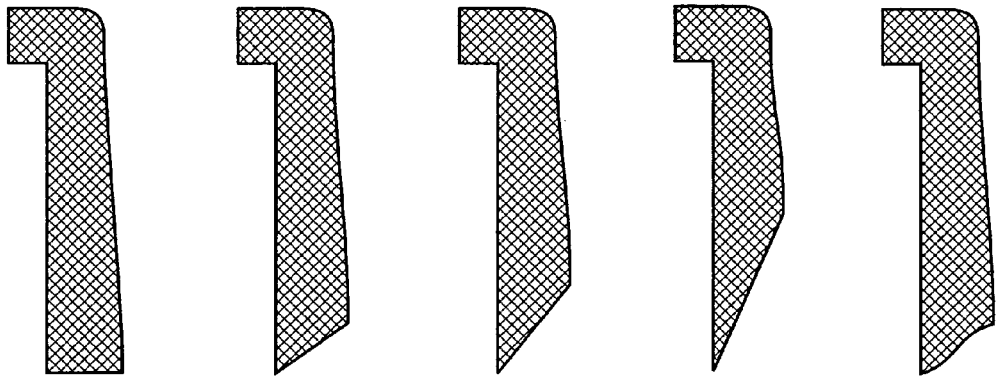
FIG. 8 is a side view of various shapes of the exhaust outlet at the second end.

The second end of the exhaust injection system 21 can be terminated at various angles relative to the long axis of the injection pipe 20 as shown in FIG. 8. In this embodiment, the leading edge of the injection pipe 20, as represented by A in FIGS. 1 and 7, is longer in length than the trailing edge of the injection pipe 20, which is represented by A' in FIGS. 1 and 7

In this embodiment, the second end of the exhaust injection system 21 is located in horizontal alignment with the center of the boat's propeller 25 where the boat's propeller 25 is mounted to the propeller shaft 24, thus causing the exhaust gasses to be injected into the approximate center of the prop wash, below the waterline, aft of the propeller. In yet other embodiments, there are multiple second ends of the exhaust injection system 21 that terminate within the same propeller's 25 propwash, aft of the propeller. The diameter and overall cross sectional area of the injection system is determined primarily by the requirements of the engine 30.

The exhaust injection system can be made with isotropic or anisotropic materials. In this embodiment it is made of three inch diameter stainless steel tube that has a wall thickness of 0.065 inches and is formed to shape and welded.

DETAILED DESCRIPTION OF EMBODIMENT

Exhaust Injection System on Boats that Have a Single Exhaust Outlet

Figure 3:
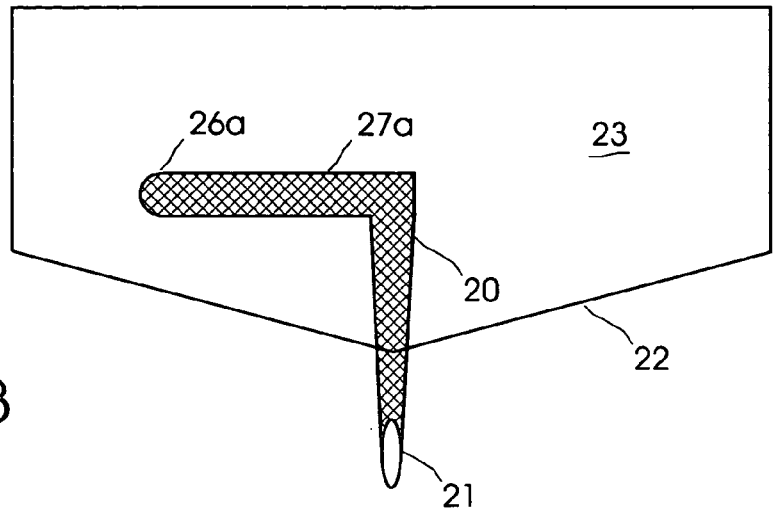
FIG. 3 is an end view of an embodiment of the invention where the boat has 1 exhaust outlet situated off center.
Figure 4:
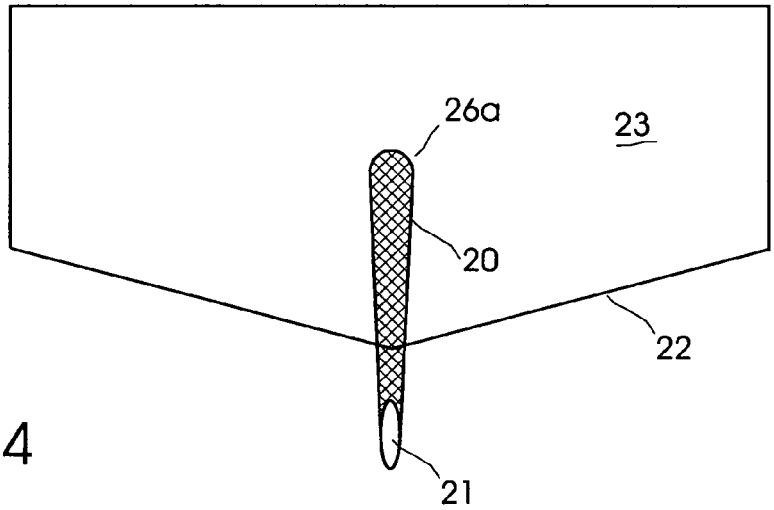
FIG. 4 is an end view of an embodiment of the invention where the boat has 1 exhaust outlet situated on center.

The above described embodiment applies to a boat that has two exhaust outlets 26*a* and 26*b*. Some boats have only one exhaust outlet. The exhaust injection system can be modified for boats that have only one exhaust outlet. If the exhaust outlet 26*a* is not in the midline of the boat, the first end of the exhaust injection system can be constructed with a single cross pipe 27*a* that connects to the injection pipe 20 in the midline of the boat as shown in FIG. 3. If the exhaust outlet 26*a* is in the midline of the boat, the first end of the exhaust injection system can be constructed so as to not have a cross pipe 27*a* or 27*b* so that the injection pipe 20 remains in the midline of the boat as shown in FIG. 4. Another approach is to install a dummy exhaust outlet that is mounted to the stern of the boat so that the embodiment designed for two exhaust outlets as described initially can be installed without further modification.

Other embodiments are contemplated for boats that have more than two exhaust outlets or that have multiple engines and propellers, resulting in the exhaust injection system having a plurality of first ends and a plurality of second ends, with the second ends terminating aft of the propeller/s and within the propwash.

DETAILED DESCRIPTION OF EMBODIMENT

Exhaust Injection System with Moveable Components to Prevent Boat Damage from Striking Objects To protect the boat in the event that the injection pipe 20 strikes a solid object, such as the bottom of the body of water or a submerged log, the attachment of the exhaust injection system to the exhaust outlets 26*a* and 26*b* can be such that upon the application of sufficient force, the injection system will separate from the exhaust outlets 26*a* and 26*b*. One way to accomplish this is to have the system attach to the exhaust outlets 26*a* and 26*b* by means of rubber hose and hose clamps. The length of the rubber hose, the quantity of hose clamps installed, and the tightening force of the hose clamps can be adjusted to determine what level of force will dislodge the system from the exhaust outlets 26*a* and 26*b*.

Figure 5:
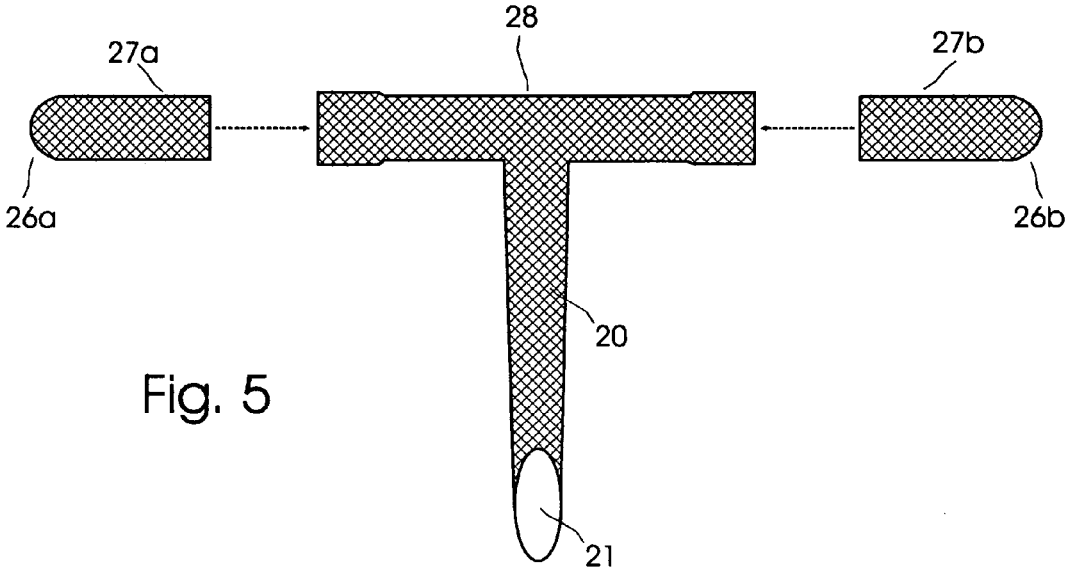
FIG. 5 is an end view of an embodiment of the invention that has slip joints within the cross pipes that allows the injection pipe to pivot rearward.

The injection pipe 20 can be designed to swing upward, pivoting on the cross pipes 27*a* and 27*b* as another way to protect the boat in the event that the injection pipe 20 strikes a solid object. In this embodiment, shown in FIG. 5, the injection pipe 20 is connected to a section of pipe to form a "Tee" 28. The arms of the Tee are expanded so that a slip joint is created by inserting the cross pipes 27*a* and 27*b* into the expanded arms of the Tee 28. This joint is completed by means of rubber hose slipped over the arms of the Tee 28 and over the cross pipes 27*a* and 27*b* and held in position with hose clamps. The length of the rubber hose, the quantity of hose clamps installed, and the tightening force of the hose clamps can be adjusted to determine what level of force is required to rotate the Tee 28 on the cross pipes 27*a* and 27*b*.

With either of these two embodiments, it is necessary that any mounting hardware allow for the freedom of movement required by the various components of the exhaust injection system.

Figure 10:
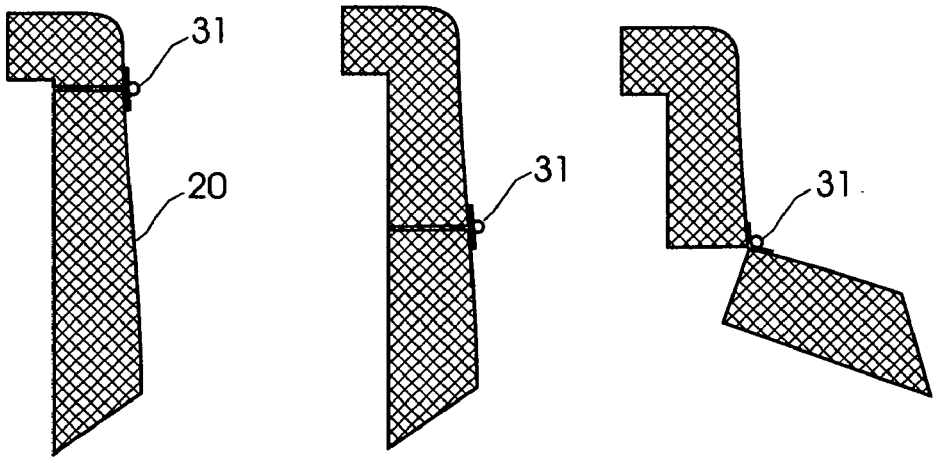
FIG. 10 is a side view of various embodiments of the injection pipe with a rearward pivoting hinge mechanism.

Yet another way to protect the boat in the event that a solid object is struck, the injection pipe 20 can be hinged to allow it to swing upwards and back. The hinge 31 can be located anywhere along the trailing edge of the injection pipe 20 as shown in FIG. 10.

DETAILED DESCRIPTION OF EMBODIMENT

Figure 11:
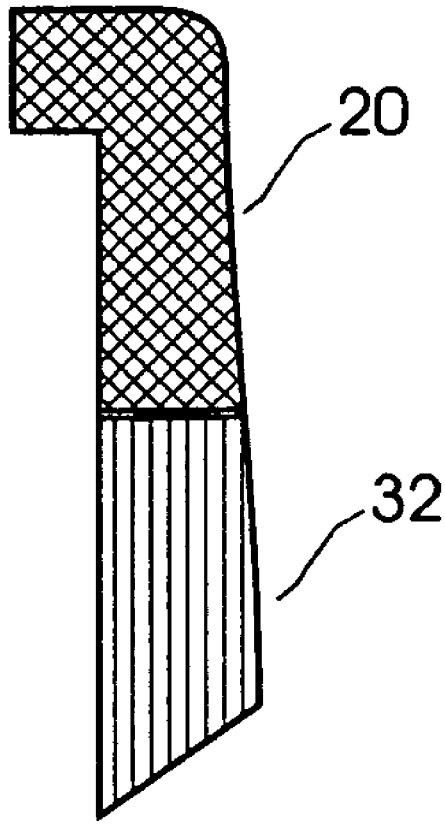
FIG. 11 is a side view of the injection pipe with a lower, sacrificial portion.

Exhaust Injection System with Sacrificial Component to Prevent Boat Damage from Striking Objects Another way to protect the boat in the event that the injection pipe 20 strikes a solid object is to make the injection pipe 20, or a portion thereof 32, sacrificial as shown in FIG. 11. In this embodiment, the lower portion 32 of the injection pipe 20 is made of PVC, plastic, fiberglass, injected molded resin, or other suitable material, having been formed into a streamlined shape. The sacrificial portion 32 of the injection pipe 20 mounts to the upper portion of the injection pipe 20 via a screw, clamp, bayonet, or other suitable fastening method. In the event that an object is struck with sufficient force, the lower sacrificial portion 32 of the injection pipe 20 will break away. Since the remainder of the exhaust injection system remains intact, the portion that broke away can be easily replaced.

DETAILED DESCRIPTION OF EMBODIMENT

Exhaust Injection System with Movable Injection Pipe

Figure 6:
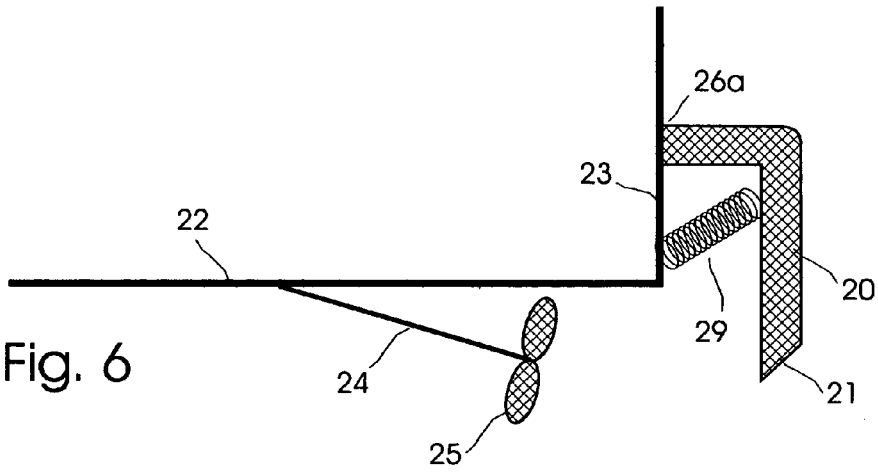
FIG. 6 is a side view of an embodiment of the invention with a spring attached holding the injection pipe in the down position.

The injection pipe 20 creates drag in the water. The amount of drag increases as the boat speed increases. One way to reduce this drag is to have the injection pipe 20 moved out of the water as the boat speed increases. Such removal of the injection pipe 20 from the water should be minimized since removing the injection pipe 20 from the water reduces the safety and environmental benefits of the system. In this embodiment, shown in FIG. 6, the Tee 28 is allowed to swivel freely upon the cross pipes 27*a* and 27*b* with O-rings incorporated into the slip joint to seal against leakage of the exhaust. The Tee 28 is held in position by means of a spring 29. The strength of the spring 29 is such that the injection pipe 20 is held within the water until at higher boat speeds, there is sufficient force from the water moving against the injection pipe 20 to overcome the resistance of the spring, thus allowing the Tee 28 to pivot on the cross pipes 27*a* and 27*b* and move the injection pipe 20 further away from its downward position, thus reducing drag. In other embodiments, different mechanical limiters could be utilized to provide the force to hold the injection pipe 20 down against the force of the water, such as other types of springs, gears, brakes, and hydraulic systems.

The above-described embodiment relied upon a passive system of resistance. In other embodiments, the injection pipe 20 could be moved by an active system such as pump driven hydraulics, hydraulics driven by the force of the water passing beneath the boat, gears, screws, or other active means of movement. The injection pipe 20 could be rotated up rearward, to the left or to the right, or it could be retracted to reduce the amount of drag in the water.

DETAILED DESCRIPTION OF EMBODIMENT

Exhaust Injection System Mounted within the Boat

Figure 9:
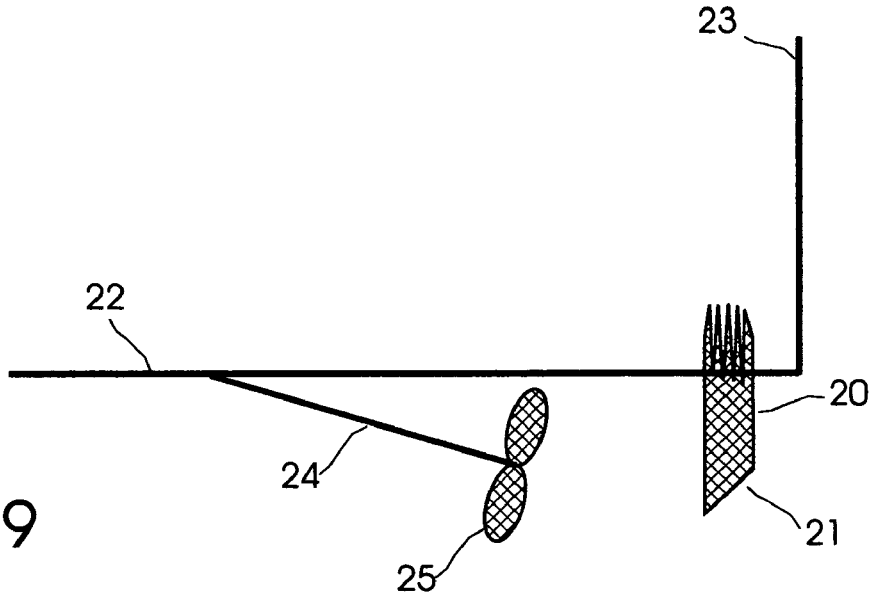
FIG. 9 is a side view of an embodiment of the invention with the majority of the exhaust system mounted within the boat (the engine and first end and other components of the exhaust system are not shown as they are considered to be conventional)

All of the previously described embodiments have generally described the exhaust injection system as being mounted upon the exterior of the boat, on the transom at the stern of the boat. The exhaust injection system can also be installed within the boat so that only the injection pipe 20 extends outside the boat, as shown in FIG. 9, such that the terminus of the injection pipe 20 is located aft of the propeller and within the propwash.

DETAILED DESCRIPTION OF EMBODIMENT

Exhaust Injection System with Construction Using Composite Material

In another embodiment of the exhaust injection system, the exhaust injection system can be constructed as described in the several embodiments above, except that instead of using stainless steel for the construction, composite materials, such as fiberglass and resin, can be utilized as the construction material, such that the exhaust injection system includes the injection pipe 20 and other attributes described in this invention.

DETAILED DESCRIPTION OF EMBODIMENT

Exhaust Injection System with Construction Using Molding Techniques

In another embodiment of the exhaust injection system, the exhaust injection system can be constructed using compression molding, roto-molding, vacuum molding, or other molding techniques, utilizing the range of materials that are available and appropriate for the respective molding technique, such that the exhaust injection system includes the injection pipe 20 and other attributes described in this invention. Throughout this discussion of this invention, the terms pipe, piping and tube are used interchangeably and are to be construed in the generic sense as a conduit for the flow of the exhaust gasses. Having described several embodiments of the invention in detail, various modifications and improvements will readily occur to those skilled in the art. Such modifications and improvements are intended to be within the spirit and scope of the invention. Accordingly, the foregoing description is by way of example only and is not intended as limiting. The invention is limited only as defined by the invention's claims and their equivalents.

What is claimed:

1. A boat exhaust system comprising a boat comprising at least one engine mounted inside the boat, such that the engine produces an exhaust gas, at least one engine exhaust outlet, and at least one propeller mounted upon a propeller shaft wherein the propeller shaft exits the boat's hull under the boat, such that the propeller generates a propwash;

a waterline relative to the boat; and an exhaust injection system comprising injection piping, such that the injection piping has a first end connected to the engine exhaust outlet, and a second end positioned below the waterline, aft of and generally in line with the propeller, such that at least a portion of the exhaust gas is exhausted through the second end, in proximity to the propwash, the injection piping comprising a first pipe section, such that the first pipe section is attached to a first engine exhaust;

a second pipe section, such that the second pipe section is attached to a second engine exhaust; and a third tee section, attached to the first pipe section, the second pipe section, and the second end, such that the third tee section may pivot away from the boat.

2. A boat exhaust system comprising a boat comprising at least one engine mounted inside the boat, such that the engine produces an exhaust gas, at least one engine exhaust outlet, and at least one propeller mounted upon a propeller shaft wherein the propeller shaft exits the boat's hull under the boat, such that the propeller generates a propwash;

a waterline relative to the boat; and an exhaust injection system comprising injection piping, such that the injection piping has a first end connected to the engine exhaust outlet, and a second end positioned below the waterline, aft of and generally in line with the propeller, such that at least a portion of the exhaust gas is exhausted through the second end, in proximity to the propwash, the injection piping comprising a first pipe section, such that the first pipe section is attached to a first engine exhaust;

a second pipe section, such that the second pipe section is attached to the boat; and a third tee section attached to the first pipe section, and the second pipe section.

* * * * *